United States Patent [19]

Stahle

[11] 4,347,035

[45] Aug. 31, 1982

[54] CENTRIFUGAL PUMP WITH SINGLE BLADE IMPELLER

[76] Inventor: Martin Stahle, Postfach 12, CH-8213 Neunkirch, Switzerland

[21] Appl. No.: 29,650

[22] Filed: Apr. 13, 1979

[30] Foreign Application Priority Data

Aug. 31, 1978 [CH] Switzerland ..... 918578

[51] Int. Cl.[3] ..... F01D 15/00

[52] U.S. Cl. ..... 415/121 B; 241/46.17; 415/71

[58] Field of Search ..... 415/121 B, 71–74; 241/46.17

[56] References Cited

U.S. PATENT DOCUMENTS

| | | | |
|---|---|---|---|
| 2,042,641 | 6/1936 | Victoria | 415/74 |
| 3,156,190 | 3/1963 | Stahle . | |
| 3,444,818 | 5/1969 | Sutton | 415/121 B |
| 3,771,900 | 11/1973 | Baehr | 415/72 |
| 3,907,456 | 9/1975 | Krienke | 415/71 |
| 3,958,723 | 5/1976 | Stahle | 415/72 |
| 4,143,993 | 3/1979 | Blum | 415/121 B |

FOREIGN PATENT DOCUMENTS

| | | | |
|---|---|---|---|
| 499726 | 1/1971 | Switzerland . | |
| 408159 | 4/1934 | United Kingdom | 415/121 B |

*Primary Examiner*—Philip R. Coe
*Assistant Examiner*—Timothy F. Simone
*Attorney, Agent, or Firm*—Browdy and Neimark

[57] ABSTRACT

A centrifugal pump which has a single-blade impeller and is used particularly for the transport of long-fibered deposited solids, for example, in sewage. The pump impeller discharge end lies in a radial plane adjacent a housing wall there being a clearance between the housing wall and the discharge end. The blade face is directed to the housing wall to form an acute angle with that wall, the line between the outer extremity of the blade and the discharge end of the blade forms an acute angle relative to the axial direction of the impeller. The front edge of the impeller is sharpened and provides a moving shearing edge, and the housing wall provides a stationary shearing edge so that medium pumped into the impeller can be cut and disintegrated between these edges. The angles defined facilitate drawing the long-fibered solids into the area for shearing and disintegration.

11 Claims, 6 Drawing Figures

CENTRIFUGAL PUMP WITH SINGLE BLADE IMPELLER

TECHNICAL FIELD

This invention relates to a centrifugal pump with a single blade impeller of the open or the closed type. In particular the invention is directed to pumps for use in the transport of long-fibered deposited solids. The discharge end of the impeller blade of such a pump grazes a housing wall lying in a radial plane such that there is a clearance btween the housing wall and the discharge end.

BACKGROUND

Long-fibered solids, for example, ropes, nylon stockings and similar items which may be contained in sewage, have a tendency that the part which first emerges from the impeller blade of a pump having a single blade impeller wraps itself round the impeller so that the emerging part again enters the impeller channel from the other side of the blade flank. This forms a loop with the part still remaining in the impeller channel which disturbs the fluid flow and results in other solid parts becoming stuck in the impeller, hence leading to the blockage of the pump.

Known pumps for such deposited solids have sought to overcome the problem by placing above the blade discharge edge a knife for cutting open the suspended long-fibered solids. A disadvantage of this arrangement is that solids which cannot be cut by the blade jam between the impeller blade and the housing wall and block the impeller. Further, as the knife is directly exposed to the entire conveying stream with all its deposited abrasive solids, it quickly leads to the knife being blunted unnecessarily.

DISCLOSURE OF THE INVENTION

The present invention provides a centrifugal pump including a single blade impeller, such impeller having a hub, a feeding end and a discharge end, and a housing wall lying in a radial plane relative to the impeller. The discharge end of the blade grazes the housing wall such that there is a clearance between the housing wall and the discharge end. The plane of the blade face is directed towards the housing wall and an extension of the blade plane through the housing wall forms a first angle which is acute with that portion of the wall trailing the direction of rotation of the impeller and the line between the radial extremity of the surface of revolution of the blade and the discharge end of the surface of revolution of the impeller blade forms a second angle which is an acute angle relative to the axial direction of the impeller. The impeller adjacent the housing wall has a front edge defined between the impeller hub and the radial spiraling outer edge and the extension of such front edge forms a third angle which is an acute angle with the tangential line to the radial edge of the blade in a direction trailing the direction of rotation of the impeller.

With the first and second angles that portion of fibrous material winding around the impeller discharge can slide down against the housing wall or be washed against it. The third angle has the effect that firmly suspended loops of fibrous material which slide down against the housing wall along the blade edge can be engaged by the front edge and, as a result of the impeller rotation, ground or torn in the gap between the front edge and the housing wall. The sliding of parts of fibrous material against the housing wall along the blade edge occurs all the more with a larger second angle and a smaller first angle.

Disintegration of those parts of fibrous material which slide down from the blade edge against the housing wall is facilitated by having the edge sharpened (i.e., without a radius). A significant improvement in the cutting effect can be achieved by providing the housing-wall section which is grazed by the front edge of the inpeller blade with a sharp cutting edge which, seen in the rotational direction of the impeller is directed outwardly towards the perimeter of the housing in the direction of rotation of the impeller, the projection of the edge forming a fourth angle with a tangential line of the housing wall perimeter, such fourth angle being an acute angle. This cutting edge can be formed by the radial inner boundary edge of a spiraling slotted section which may run around a part of the circumference of the housing ring-surface grazed by the front edge of the impeller blade, or by the cutting edge of a knife projecting from the housing wall.

BRIEF DESCRIPTION OF DRAWINGS

My invention is described more particularly below with reference to the accompanying drawings which are.

Figure 1:
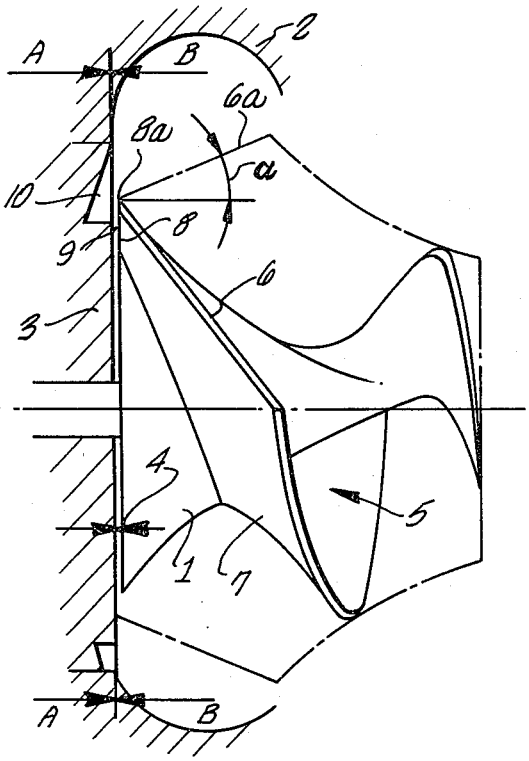
FIG. 1—a side elevation of a single-blade impeller of a centrifugal pump with a housing-wall portion axially sectioned, FIG. 2—a plan view of FIG. 1, FIG. 3—a front view of the impeller in the direction of arrows A—A in FIG. 1, FIG. 4—a front view of the pressure side housing wall in direction of arrows B—B in FIG. 1, FIG. 5—a partial plan view of the pressure side housing wall illustrating a second embodiment of the wall, and FIG. 6—a section along line C—C of FIG. 5 illustrting detailed description.

A single-blade impeller of a centrifugal pump has a cone hub 1, which is supported in a housing 2 in a maner which is not described in detail. The front surface of hub 1, lying in a radial plane, lies with the discharge end of the impeller adjacent a housing wall 3, there being a small clearance 4 between the impeller face and the face of housing wall 3. The blade itself is indicated by numeral 5, its edge by numeral 6 and its pressure side end flank with numeral 7.

In FIG. 1 the surface of revolution of the edge 6 is shown in phantom line 6*a*. The line between the extermity of the surface of revolution, as indicated by 6*a* of the blade and the discharge end of the impeller blade forms a second angle (being indicated by $\alpha$) with the axial direction of the impeller this angle $\alpha$ being acute . Angle $\alpha$ may practically be from three degrees upwards but in practice greater advantage is obtained by having an angle of about twenty-two degrees as is indicated in FIG. 1.

A first angle indicated by the symbol $\beta$ is defined between the extension through the housing wall 3 of the plane of that portion of the blade face which is closest to the housing wall 3, with that portion of the wall housing trailing the direction of rotation. Angle B must be acute, but in practice of this angle should not exceed about forty-five degrees.

Figure 3:
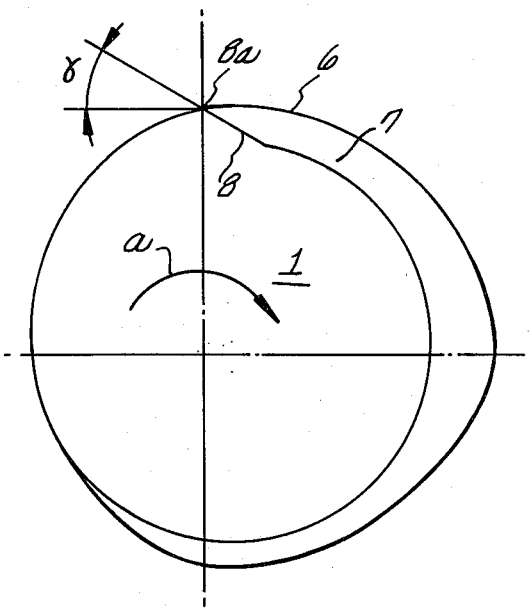
Figure 2:
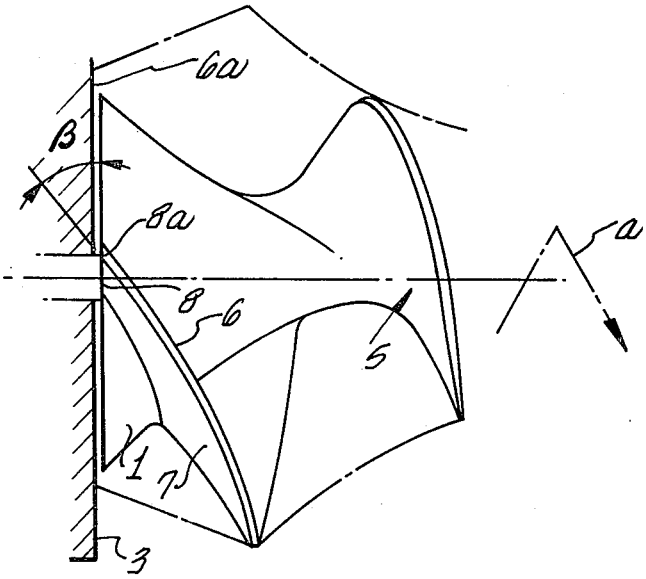

As can be seen from FIG. 3 the front edge 8 closing the pressure-side blade flank 7 against the housing wall 31 joins the end edge 6 of the blade 5 at a point indicated by numeral 8*a*. An extension of this front edge 8, defined between the impeller hub 1 and the radially spiraling outer edge 6, forms a third angle, with the line normal to the radius from the axis of the blade 5 to the point 8*a*, in a direction trailing the direction of rotation of the impeller, which angle is actue. The front edge 8 is additionally made especially sharp.

Figure 4:
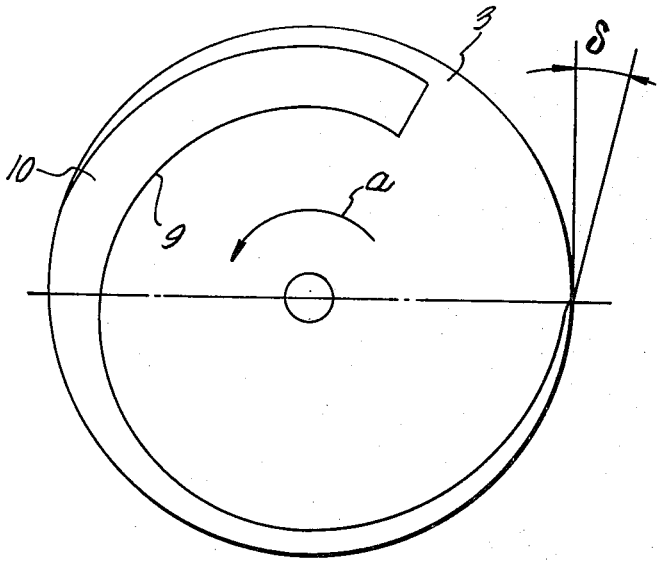

As is illustrated in FIGS. 1 and 4 the housing wall 3 has a spiral edge 9 running outwardly in the rotational direction of the impeller. This edge forms the radially inner edge of a wedge-shaped slot 10 which is milled out of the housing wall 3 as indicated. The angle of inclination 8 of this edge 9 is acute and expediently less than forty-five degrees, the angle 8 being defined between an extension of the shearing edge 9 beyond the perimeter of the housing wall in the direction of rotation of the impeller, and the tangential line of the housing wall perimeter leading the direction of rotation at the point of intersection of edge 9 with the housing perimeter. The edge 9 forms a stationary shearing edge, with which the front edge 8 of the impeller blade interacts, such edge being a mobile shearing edge.

In operation of the described pump, the impeller rotates in the direction a and it feeds material from the inlet end of the impeller (the righthand side in FIG. 1) axially to the tangential discharge end in the zone of the housing wall 3. Deposited long-fibered solids, hanging firmly on the blade can slide along the blade, end edge 6 toward the housing wall 3. This becomes easier the larger the second angle $\alpha$ and the smaller the first angle $\beta$ is. Solids are there engaged by the front edge 8 and cut in interaction with edge 9, torn and then disintegrated in gap 4 between edge 8 and the housing wall 3. If the third and fourth angles, namely, $\gamma$ and $\delta$ are each smaller than forty-five degrees, the intersecting shearing edges 8 and 9 form a large obtuse angle so that solid parts which are not broken up can be ejected and washed away. As a result the shearing edges are protected, and a jamming of input medium between the shearing edges with the consequent danger of blockage of the impeller is avoided.

Figure 5:
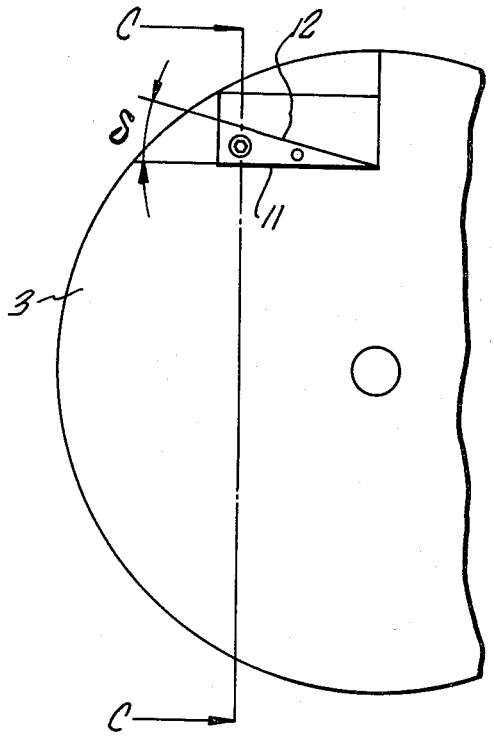
Figure 6:
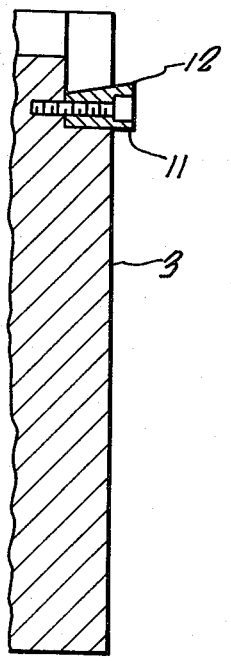

In the second embodiment of the invention the spiral-shaped shearing edge 9 is replaced with a knife 11 which is inserted into the housing wall 3 and projected therefrom with a shearingedge 12. This is illustrated in FIGS. 5 and 6 of the drawings. The equivalent fourth angle $\delta$ is illustrated in these drawings. The knife 11 projects slightly from a recess in the housing 3. The stationary shearing edge 12 interacts with the mobile shearing edge 8 of the impeller on every rotation of the impeller. Several knives could be provided on the ring section of the housing wall 3 as may be required.

The above descriptions of the invention are susceptible to various other modifications, changes and adaptions, and the invention is not to be limited to the details herein but is of the full scope of the appended claims.

I claim:

1. A centrifugal pump for pumping fluids containing long-fibered solids, comprising:

a housing having an axial inlet, a tangential outlet and a substantially planar end wall, perpendicular to the axis of the housing, opposite the inlet end thereof, a single blade impeller mounted to rotate within said housing, said impeller having a substantially cone-shaped hub and a screw blade mounted on said hub, said blade having a radially outer edge having a configuration that upon rotation defines a surface of revolution which flares from the inlet end of said housing towards said end wall to a maximum diameter between said inlet and said end wall and then slopes inwardly towards said end wall; and cutting means in the area of the intersection of said blade and said end wall for cutting long-fibered solids, whereby long fibered solids in the fluid handled by said pump which become entangled on said blade slide toward said end wall on the portion of said blade defining the inwardly sloping portion of said surface of revolution and enter the area of said cutting means where they are cut and then be discharged from the pump.

2. A centrifugal pump in accordance with claim 1, wherein the plane of that portion of the blade closest to said end wall, when extended through said end wall, forms an acute angle $\beta$ with said end wall in the direction trailing rotation of said impeller.

3. A centrifugal pump in accordance with claim 2, wherein $\beta$ is less than 45°.

4. A centrifugal pump in accordance with claim 1, wherein the inwardly sloping portion of said portion of said surface of revolution forms an angle $\alpha$ with the axis, in a plane containing said axis, of about 22°.

5. A centrifugal pump in accordance with claim 1, wherein said impeller includes an end edge substantially parallel to the plane of said end wall, which edge runs between the point on said blade forming the end of said inwardly sloping surface of revolution closest to said end wall, and the point on said blade adjoining said hub closest to said end wall, wherein an outward extension of said end edge forms an acute angle $\gamma$ with the line parallel to the plane of said end wall which is normal to the radius from the axis at the radially outermost point of said end edge, and wherein said cutting means comprises a wedge-shaped slot in said end wall, the radially inner edge of which spirals outwardly in the direction of rotation of the impeller, the inner edge of said slot forming a stationary shearing edge with which said end edge of said blade interacts as a mobile shearing edge to accomplish said cutting function.

6. A centrifugal pump in accordance with claim 5, wherein said angle $\gamma$ is less than 45°.

7. A centrifugal pump in accordance with claim 6, wherein the inner edge of said slot spirals at a rate such that the intersecting shearing edges form a large obtuse angle.

8. A centrifugal pump in accordance with claim 1, wherein said impeller includes an end edge substantially parallel to the plane of said end wall, which edge runs between the point on said blade forming the end of said inwardly sloping surface of revolution closest to said end wall, and the point on said blade adjacent said hub closest to said end wall, wherein an outward extension of said end edge forms an acute angle $\gamma$ with the line parallel to the plane of said end wall which is normal to the radius from the axis at the radially outermost point of said end edge, and said cutting means comprises a knife mounted on said end wall and having a stationary shearing edge with which said end edge of said blade intersects as a mobile shearing edge to accomplish said cutting function.

9. A centrifugal pump in accordance with claim 8, wherein said knife is disposed in a recess in said end wall and projects slightly therefrom in the direction of said impeller.

10. A centrifugal pump in accordance with claim 8, wherein said angle $\gamma$ is less than 45°.

11. A centrifugal pump in accordance with claim 5 or claim 8 wherein said end edge of said blade, acting as said mobile shearing edge, is sharpened.

* * * * *